United States Patent [19]

Breslow et al.

[11] 4,174,835

[45] Nov. 20, 1979

[54] COMPETITIVE GAME

[75] Inventors: Jeffrey D. Breslow, Highland Park; Michael J. Ferris; Henry Arias, both of Chicago; Walter J. Wozniak, Addison, all of Ill.

[73] Assignee: Marvin Glass & Associates, Chicago, Ill.

[21] Appl. No.: 865,735

[22] Filed: Dec. 29, 1977

[51] Int. Cl.[2] ..... A63B 71/04; A63F 9/02

[52] U.S. Cl. ..... 273/101; 273/105 R; 124/64

[58] Field of Search ..... 273/101, 105 R, 95 C, 273/119 B, 129 F; 124/64, 61

[56] References Cited

U.S. PATENT DOCUMENTS

| | | | |
|---|---|---|---|
| 1,827,885 | 10/1931 | Emenhiser | 273/119 B |
| 1,850,715 | 3/1932 | Gottfried | 273/105 R |
| 2,201,025 | 5/1940 | Cadman | 273/119 B |
| 2,666,642 | 1/1954 | Ward | 273/105 R |
| 3,592,470 | 7/1971 | Breslow | 273/101 |
| 4,004,806 | 1/1977 | Malik | 124/61 |
| 4,076,006 | 2/1978 | Breslow et al. | 124/64 |

FOREIGN PATENT DOCUMENTS

| | | | |
|---|---|---|---|
| 2716361 | 3/1977 | Fed. Rep. of Germany | 124/61 |
| 170920 | 10/1921 | United Kingdom | 273/101 |
| 641504 | 8/1950 | United Kingdom | 273/101 |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A competitive game device wherein opposed projectile launching stations are interconnected by a bridge containing a plurality of linearly spaced target receptacles, each suitable for receiving a plurality of projectiles. The launching stations are provided with launching platforms for positioning a projectile preparatory to launching. Manually operable propulsion devices are provided at each launching station for allowing each opposing player to launch projectiles in the direction of the target receptacles. Sets of projectiles for each player are differentiated by distinctive colors or symbols. The players may establish the rules of the game with respect to the number of projectiles to be launched and concurrent or sequential operation of their respective propulsion devices. Victory may be awarded to the player who first lands a specified number of his projectiles in one or more of the target receptacles. It has been found that the game is particularly entertaining when the players operate their respective propulsion devices concurrently and when victory falls to the first player who succeeds in landing one of his projectiles in the topmost position in four of the five target receptacles provided in the bridge.

4 Claims, 2 Drawing Figures

COMPETITIVE GAME

BACKGROUND OF THE INVENTION

This invention relates to game devices and, in particular to a game device used by competing players to propel projectiles by mechanical or pneumatic means from opposing projectile launching stations toward one or more targets between the launching stations.

Game devices employing mechanical or pneumatic means for propelling projectiles are well known. However, such devices are generally in the nature of a gun or the like, which is aimed and fires a projectile at a target having no particular physical association with the projectile propulsion means. The use of such devices requires somewhat complex and time-consuming procedures for loading the propulsion means and for retrieving the fired projectile. Such devices are not suitable for concurrent repetitive use by a plurality of players. Examples of such devices are shown in Copper et al U.S. Pat. No. 650,633 issued May 29, 1900; Fuda U.S. Pat. No. 1,033,094 issued July 23, 1912; Bednar U.S. Pat. No. 2,993,297, issued July 25, 1961 and Antonelli Italian Pat. No. 474,435 issued Sept. 23, 1952.

By greatly simplifying the loading of the propulsion means and the retrieval of fired projectiles by confining the target intermediate opposed projectile launching stations and by providing for simple repetitive and optionally rapid and concurrent operation of opposed launching stations, the present invention seeks to satisfy the continuing need for a competitive game which opposing players may play at such pace and intensity as conforms to their abilities and desires.

SUMMARY OF THE INVENTION

The present invention relates to a device providing pneumatically actuated projectile launching means at opposite ends of a housing. The intermediate portion of the housing is provided with cup-shaped targets for launched projectiles. Propulsion means for launching the projectiles are operated by manually squeezing or hitting a flexible air bulb. Rules for the game may be adopted by the players to suit their desires and levels of skill. It has been found that the game is particularly enjoyable to adults when five separate targets are provided and when the players operate their respective launching means concurrently and victory is awarded to the player who succeeds in landing one of his projectiles in the topmost portion in four of five targets.

Other objects, features and advantages of the invention will be apparent from the following detailed description taken in connection with the accompanying drawings.

DETAILED DESCRIPTION OF THE PREFERRED EMBODIMENT

Figure 1:
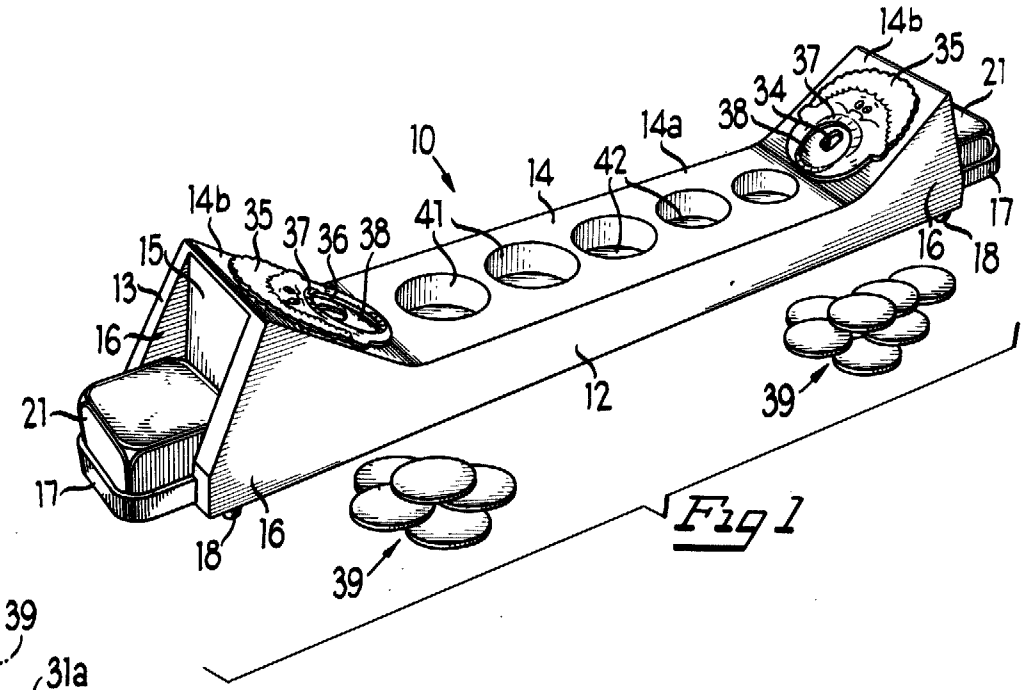
FIG. 1 is a perspective view of the present invention and shows projectiles suitable for use with the invention.

The game device of the present invention, generally designated 10, comprises an elongated housing of generally rectangular configuration 11 in which two parallel longitudinal sidewalls 12 support a top wall 14 having an intermediate bridge portion 14*a* between a pair of upwardly sloping end portions 14*b*. From the top of the sloping end portions 14*b*, a pair of generally vertical end walls 15 extend downwardly between elongations or flanges 16 of the sidewalls 12.

A pair of horizontal shelves 17 project outwardly from the end walls 15 and are supported by the lower portions of flanges 16. A plurality of resilient feet 18 are secured to the bottom of each shelf 17 to support housing 11 on any convenient surface, such as a floor of a residential room or a table top.

A generally rectangular air bulb 21 fits on the top of each shelf 17 and is secured against accidental displacement by peripheral flanges 19 surrounding the free ends of shelves 17. Bulb 21 is made of rubber, plastic or other suitable flexible material which permits manual compression and causes the bulb to resume its original shape very quickly upon termination of such pressure. Bulbs 21 communicate with chambers or cylinders 24 positioned below each slope 14*b* through a pair of conduits 22, which extend through apertures 23 provided in end walls 15. The position of each cylinder 24 is fixed by an internal frame member 25 which connects with the interior faces of the end wall 15 and slope 14*b*.

The remote end of conduit 22 communicates with the interior of cylinders 24 through a sleeve 26 protruding from the bottom wall 27 of the cylinders 24 for frictionally engaging the remote end of conduit 22. The bottom wall 27 supports a vertically movable plunger 28 which includes a flange 29 from which a finger 31 having a tip 31*a* extends upward through cylinders 24 and through an aperture 32 provided in the top wall 33 of cylinder 24. Another aperture 34, in alignment with aperture 32 and finger 31, is provided in slope 14*b*.

Figure 2:
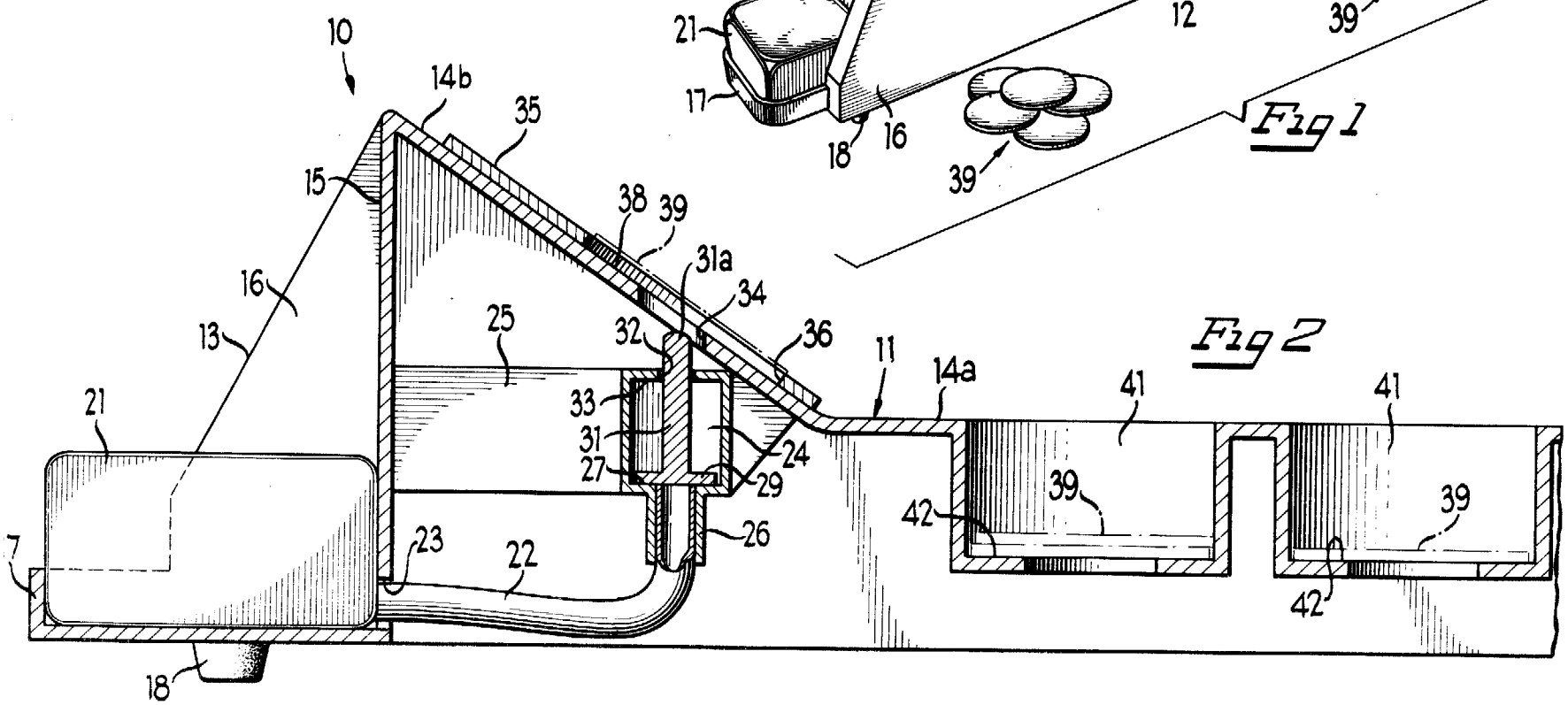
FIG. 2 is a fragmentary sectional view on an enlarged scale taken generally along line 2—2 of FIG. 1.

A plate 35 contoured and painted to simulate the front view of an open mouthed face is attached to the top side of slope 14*b* so that the inside wall 36 of the open mouth 37 surrounds aperture 34 and defines a launching platform 38 for positioning a disc-shaped projectile 39, as shown by dotted lines in FIG. 2. In the embodiment shown, plate 35 is located on slope 14*b* so that aperture 34 is in the upper portion of launching platform 38.

A plurality of cup-shaped recesses 41 in bridge 14*a* are generally aligned between the apertures 34 to form targets for projectiles 39 launched from platform 38. The depth of each recess 41 is dimensioned so as to allow a plurality of projectiles 39 to stack upwardly from the bottom wall 42 of recess 41 as shown in dotted lines in FIG. 2. An aperture 43 in bottom wall 42 allows projectiles 39 to be manually lifted out of recess 41.

Preferably the projectiles 39 are provided in a plurality of differentially color-coded series, one of which is to be allocated to each participant in the game.

In operation, bulb 21 is momentarily compressed by manual hitting or squeezing after a projectile 39 has been placed on platform 38. Such compression causes air to rush from the interior of bulb 21 through conduit 22 to impart forceful upward movement to plunger 31 within the confines of top wall 33 and bottom walls 27 of cylinder 24. Such movement causes fingertip 31*a* to strike the downside face of the disc-shaped projectile 39 positioned on launching platform 38. The slanted position of projectile 39 on platform 38 in conjunction with the eccentric impact of fingertip 31*a* against projectile 39 propels the projectile on a ballistic path generally in line with apertures 34. The force of the strike of fingertip 31*a* against projectile 39 depends on the force and rapidity with which air bulb 21 is manually hit or squeezed, thus enabling a participant in the game to aim the projectile particularly toward one of the targets. Upon termination of manual compression of bulb 21, the bulb quickly resumes its precompression configuration and thus allows rapid repetition of strikes of fingertip 31*a* against projectiles 39 successively positioned on platform 38.

The game forming the subject matter of the present invention may be played by one player or may be competitively played by a plurality of contestants. In the latter alternative, it will be desirable to provide each player with a set of visually distinguishable but otherwise identical projectiles. Players will tend to acquire a certain degree of skill in operating the launching mechanism and in retrieving straw projectiles and positioning projectiles on the launching platform. Players will have no difficulty in devising rules for playing the game and determining the winner. Handicaps may also be introduced to compensate for a competing player's lack of skill.

It has been found that reasonably skilled players find the game particularly enjoyable when each player operates a launching mechanism as rapidly as can be and more or less simultaneously with an opposing player's operation of another launching mechanism. In this mode of the game, projectiles launched from opposing stations may collide in flight and thus add to the excitement, interest and unpredictability of the game. In this preferred mode of operation of the game, projectiles launched by participants may land in any sequence in any of the targets and may stack up in the targets. When the game is played in this preferred mode, a desirable way of determining the winner is to award victory to the player who first succeeds in landing four of his projectiles in the topmost position in four of the five targets.

The foregoing detailed description has been given for clearness of understanding only and no unnecessary limitations should be understood therefrom as some modifications will be obvious to those skilled in the art.

What is claimed and desired to be secured by Letters Patent of the United States is:

1. A game apparatus, comprising:

a plurality of sets of generally disc-shaped playing pieces, one set for each player of the game, each playing piece having indicia thereon distinguishing one set thereof from another set;

means defining a central, generally flat horizontal playing surface interconnecting the launching stations;

a plurality of opposed playing piece launching stations, each launching station including manually operable pneumatic playing piece propulsion means for launching a playing piece toward an opposing launching station, said playing piece propulsion means including a manually compressible air bulb, a cylinder communicating with said air bulb and mounted in a vertical position relative to the playing surface, and a plunger movably positioned in and guided by said cylinder to propel a playing piece in an end over end trajectory in response to compression of said air bulb;

means defining a launching retainer for receiving and supporting one of said playing pieces in a canted position relative to said playing surface for launching thereacross; and a plurality of generally tubular shaped recesses formed in said playing surface, each recess being of sufficient depth to receive a plurality of playing pieces stacked on top of one another, said recesses being in a predetermined pattern whereby the object of the game is to launch a plurality of playing pieces into said recesses by a player of the game in an attempt to have the playing pieces of his respective set occupy the uppermost position in a predetermined number of recesses.

2. The game device of claim 1 wherein each of launching retainers has a rimmed launching platform for receiving and positioning a playing piece at said angle for launching, and a generally vertically directed aperture defined in said launching platform, said pneumatic propulsion means including a movable plunger for movement at least partly through said aperture to strike and propel a playing piece positioned on said launching platform.

3. The game device of claim 1 wherein each launching retainer is dimensioned and shaped to correspond to the disc-shaped projectiles and wherein the apertured portion of the platform defined by said retainer is located above the center of the platform.

4. A game device comprising:

an elongated body having an intermediate portion, and opposed end portions raised above said intermediate portion;

at least one recessed cup-shaped target for launched projectiles provided on said intermediate portion;

a pair of upwardly sloping projectile launching stations for disc-shaped projectiles on said raised opposed end portions including an apertured platform defined by a disc retaining collar;

each of said projectile launching stations provided with pneumatic launching means including a manually compressible air bulb, a launch chamber below each of said launching stations, an air duct interconnecting each air bulb to an associate launch chamber, and a plunger movable upwardly through said apertured platform to strike a projectile positioned on the associated launching station, and to propel said projectile toward said cup-shaped target in response to manual compression of said flexible air bulb associated therewith;

each launch chamber having an apertured bottom wall supporting said plunger and having side walls and an apertured top wall defining the path of movement of said plunger, means mounting said apertured platform relative to the path of movement of said plunger whereby said path of movement of said plunger diverges substantially from the direction of the ballistic path of the struck projectile.

* * * * *